United States Patent [19]

Kato et al.

[11] Patent Number: 4,545,548

[45] Date of Patent: Oct. 8, 1985

[54] EQUAL TENSION WIRE WINDING DEVICE

[75] Inventors: Taizo Kato, Toyota; Toshiyuki Souchi, Inazawa, both of Japan

[73] Assignee: Toyoda Gosei Co., Ltd., Nishikasugai, Japan

[21] Appl. No.: 533,971

[22] Filed: Sep. 20, 1983

[30] Foreign Application Priority Data

Oct. 26, 1982 [JP] Japan ..... 57-187734

[51] Int. Cl.[4] ..... B65H 59/04

[52] U.S. Cl. ..... 242/156; 242/42; 242/54 R; 242/129.8; 242/131; 242/147 R; 87/21; 87/57

[58] Field of Search ..... 242/156, 156.2, 42, 242/129.8, 131, 131.1, 75.4, 54 R, 56.1, 147 R; 87/21, 57, 61

[56] References Cited

U.S. PATENT DOCUMENTS 2,337,977 12/1943 Davis ..... 87/21
2,911,875 11/1959 Ostermann et al. ..... 242/147 R X
3,109,605 11/1963 Ostermann ..... 242/129.8
3,117,737 1/1964 Ball et al. ..... 242/129.8
3,168,995 2/1965 Ostermann ..... 242/129.8
3,359,848 12/1967 Ostermann ..... 242/129.8 X

FOREIGN PATENT DOCUMENTS 2482634 11/1981 France ..... 87/57

*Primary Examiner*—Stanley N. Gilreath
*Attorney, Agent, or Firm*—Cushman, Darby & Cushman

[57] ABSTRACT

A wire winding device pays out thin wires from a plurality of wire reels with the same tension in an orderly manner and winds them on a take-up bobbin. The winding device is comprised of a plurality of revolving shafts juxtaposed to one another on a base and supporting the reels on which the wires are coiled; a plurality of pulleys each two of which are mounted on respective one of the revolving shafts; a plurality of braking belts trained between the neighboring pulleys for producing sliding friction; the aforementioned take-up bobbin; and a winder having a revolving shaft on which the take-up bobbin is mounted.

3 Claims, 3 Drawing Figures

EQUAL TENSION WIRE WINDING DEVICE

BACKGROUND OF THE INVENTION

1. Field of the Invention

The present invention relates to a device for unwinding a plurality of thin wires from a plurality of reels in an orderly manner and winding the wires on a take-up bobbin with the same tension in an orderly manner.

2. Description of the Prior Art

Reinforced hoses (used for supplying hydraulic pressure, for example) have rubber layers connected together by wire braiding, and the thin wires of the braiding are wound on the outer periphery of the hoses so as to intersect one another. When such braiding work for wires is done, a take-up bobbin having a plurality of wires orderly wound thereon is used, and the wires uncoiled from the bobbin are braided together on the outer periphery of a hose. During the braiding operation of wires, if tensions in the wires are not uniform, the wires wound on the outer periphery of the hose will overlap one another or bend, thus deteriorating the appearance of the hose. Consequently, it has been required that the tensions in the wires wound on the take-up bobbin be made equal.

SUMMARY OF THE INVENTION

It is the object of the present invention to provide a device capable of winding a plurality of thin wires on a take-up bobbin with the same tension in an orderly manner.

This object is achieved in accordance with the present invention by providing a wire winding device which comprises: a plurality of revolving shafts juxtaposed to one another on a base and supporting wire reels on which wires are wound; a plurality of pulleys each two of which are mounted to respective one of the revolving shafts; a plurality of braking belts trained between the neighboring pulleys for producing sliding friction; a take-up bobbin for winding the wires payed out from their respective wire reels; and a winder having a revolving shaft on which the take-up bobbin is mounted.

DESCRIPTION OF THE PREFERRED EMBODIMENT

Figure 1:
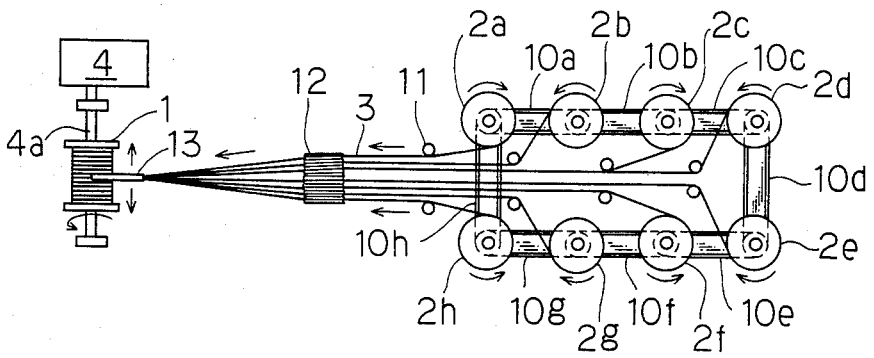
FIG. 1 is a plan view of a wire winding device according to the present invention.
Figure 2:
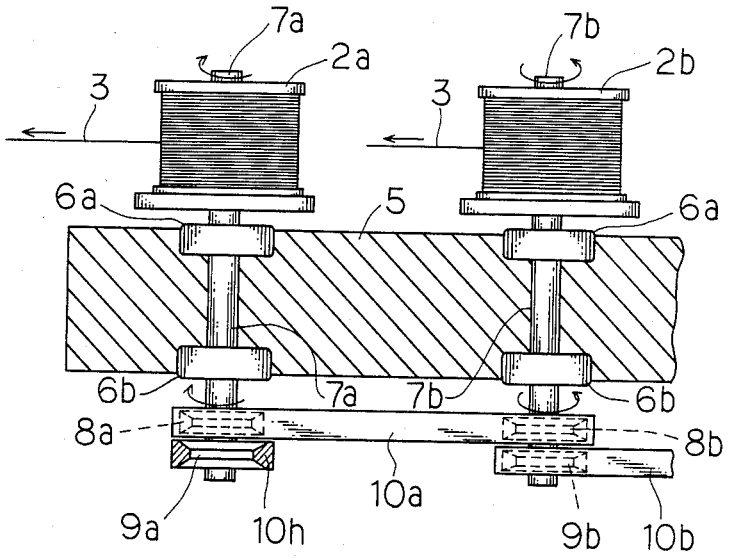
FIG. 2 is an enlarged view partially in section of the portion of FIG. 1 to which wire reels are mounted.

One embodiment of the present invention is now described with reference to the drawings, in which FIG. 1 is a plan view of a wire winding device for orderly winding thin wires 3 payed out from eight wire reels 2*a*–2*h* round a take-up bobbin 1, and FIG. 2 is an enlrged front elevation of the wire reels 2*a* and 2*b* shown in FIG. 1. The bobbin 1 is mounted to the revolving shaft 4*a* of a winder 4, and winds eight wires 3 payed out from the wire reels (disposed on the right side) around itself in an orderly manner. The eight reels 2*a*–2*h* are placed upright on a base 5 in two lateral rows and mounted to eight revolving shafts 7*a*–7*h*, respectively, which are rotatably supported by bearings 6*a* and 6*b*. The lower portions of the eight revolving shafts

Figure 3:
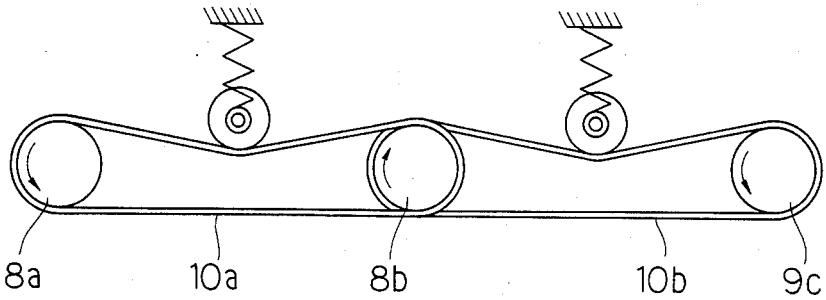
FIG. 3 is a plan view of FIG. 1 showing belt-tensioning rollers.

7*a*–7*h* each have respective two of the pulleys 8*a*–8*h*, 9*a*–9*h* fixed thereto. Eight braking belts 10*a*–10*h* are trained between the neighboring 16 pulleys disposed in this way, that is, between the pulleys 8*a* and 8*b*, between pulleys 9*b* and 9*c*, between pulleys 8*c* and 8*d*, between the pulleys 9*d* and 9*e*, between pulleys 8*e* and 8*f*, between pulleys 9*f* and 9*g*, between pulleys 8*g* and 8*h*, and between pulleys pulleys 9*h* and 9*a*, respectively. These belts 10*a*–10*h* act to impart a braking force of a certain magnitude to the revolving shafts 7*a*–7*h*, and are trained round the pulleys so as permit rotation of the pulleys 8*a*–8*h* and 9*a*–9*h*, i.e., rotation of the shafts 7*a*–7*h*, while producing sliding friction of a certain magnitude. The wires 3 are guided 11, 12, and 13. The guide 13 is so constructed as to reciprocate across the whole width of the bobbin 1 during the winding operation. It is to be noted that rollers engaging with the braking belts 10*a*–10*h* can be used to adjust the tension in the belts. See FIG. 3 for exemplary such tension-adjusting rollers for two exemplary braking belts 10*a* and 10*b*.

In the operation of the wire winding device constructed as described above, the wire reels 2*a*–2*h* are mounted to the eight revolving shafts 7*a*–7*h*, respectively, such that each neighboring two of the wire reels, which are paired with each other by one of the braking belts 10*a*–10*h*, rotate in the opposite directions when the wires 3 are payed out as shown in FIG. 1. The eight wires 3 released from these wire reels pass by the guide 12, and are made parallel to one another. Then, the space between each neighboring wire is reduced to a minimum by the guide 13 before being wound on the bobbin 1.

Under this condition, when the take-up bobbin 1 is caused to rotate by the winder 4, the eight wires 3 released from the wire reels are coiled round the bobbin 1 in parallel relation. At this time, each neighboring two of the eight wire reels 2*a*–2*h*, (for example, reels 2*a* and 2*b*), which are paired by one of the braking belts 10*a*–10*h* are trained so as to rotate in the opposite directions, and pay out the wires 3. Therefore, the eight braking belts 10*a*–10*h* cause substantially the same sliding friction, i.e., resistance to rotary sliding movement, in the respective shafts 7*a*–7*h*, thereby imparting a tension to the wires 3. thus, the wires 3 can be wound around the bobbin 1 with uniform tension. More specifically, the belts 10*a*–10*h* are each trained between their respective two of the pulleys 8*a*–8*h* and 9*a*–9*h*, which two rotate in the opposite directions. These belts are at rest and impart braking forces to their respective revolving shafts 7*a*–7*h* in response to the rotating velocity. For example, if some of the revolving shafts rotate at higher or lower velocity, the associated braking belts move. Accordingly, the variations in the rotation are suppressed by the neighboring shafts through the belts 10*a*–10*h* and so the tension in the wires 3 payed out from the wires reels 2*a* and 2*b* is maintained constant. Consequently, the eight wires 3 are wound on the bobbin 1 properly and in parallel relation without overlapping one another or bending.

As described thus far, according to the novel wire winding device, the same tension can be always given to the wires payed out from the wires reels and hence the plurality of wires can be wound on the take-up bobbin in parallel relation. Thus, by using the bobbin on which the wires are coiled parallel to make braided wires for a reinforced hose, the wires can be wound on the outer periphery of the hose so as to be arranged parallel and intersect one another. In addition, the appearance of the reinforced hose is not deteriorated due to overlapping or bending of the wires.

What is claimed is:

1. A wire winding device for maintaining equal tension in the wound wires comprising:

a base;

a plurality of revolving shafts juxtaposed to one another on the base and supporting wire reels on which wires are wound;

a plurality of pulleys each two of which are mounted to respective ones of the revolving shafts;

a plurality of braking belt means, each respectively and uniquely trained between pulleys of paired neighboring reels, for producing sliding friction between said pulleys as said reels are payed out in opposite rotational directions within each of said pairs;

a take-up bobbin for winding thereon the plurality of wires payed out from the wire reels; and a winder having a revolving shaft on which the take-up bobbin is mounted.

2. A wire winding device as in claim 1, further comprising guide means disposed between the wire reels and the winder for guiding the wires.

3. A wire winding devce as in claim 1, further comprising rollers engaging with the braking belt means to adjust the tensions in the belts.

* * * * *